United States Patent [19]

Kaneko

[11] Patent Number: 4,764,133

[45] Date of Patent: Aug. 16, 1988

[54] MALE TERMINAL FOR ELECTRICAL CONNECTION

[75] Inventor: Tomohisa Kaneko, Shizuoka, Japan

[73] Assignee: Yazaki Corporation, Japan

[21] Appl. No.: 16,328

[22] Filed: Feb. 19, 1987

[30] Foreign Application Priority Data

Feb. 19, 1986 [JP] Japan ..... 61-21555[U]

[51] Int. Cl.[4] ..... H01R 13/02

[52] U.S. Cl. ..... 439/889; 439/845; 439/883; 439/850

[58] Field of Search ..... 339/278 R, 278 M, 278 T; 439/276 E, 276 T, 276 R, 277 R, 258 R, 258 F, 258 S, 256 R, 256 SP, 889, 883–884, 830, 832, 840, 842, 845, 848–850, 859–862, 894

[56] References Cited

U.S. PATENT DOCUMENTS

| | | | |
|---|---|---|---|
| 2,511,806 | 6/1950 | Macy | 339/276 T |
| 2,552,392 | 5/1951 | Batcheller | 339/256 SP |
| 2,785,387 | 3/1957 | Batcheller | 339/256 SP |
| 3,660,806 | 5/1972 | De Stephan | 339/256 SP |
| 4,415,221 | 11/1983 | Inoue et al. | 439/849 |
| 4,579,409 | 4/1986 | Enneper et al. | 439/850 |
| 4,679,887 | 7/1987 | Jackson | 439/849 |
| 4,691,981 | 9/1987 | Coldren | 439/849 |

*Primary Examiner*—Gil Weidenfeld
*Assistant Examiner*—Paula A. Austin
*Attorney, Agent, or Firm*—Wigman & Cohen

[57] ABSTRACT

A male terminal for electrical connection fittable to a female terminal includes; a tab as an electrical connection section, which is fitted to a tab receptacle of the female terminal when the male terminal is fitted to the female terminal sheet, and at least one recess formed on the one side of the tab so as to be contactable with protruding contact member provided on the tab receptable of the female terminal. The recess is formed by forging processing. The depth of the recess is adjusted in accordance with the width of a space of the tab receptable so as to be able to adapt to various sizes and shapes of the female terminal.

8 Claims, 4 Drawing Sheets

MALE TERMINAL FOR ELECTRICAL CONNECTION

BACKGROUND OF THE INVENTION

1. Field of the Invention

This invention relates to a male terminal for electrical connection, and more particularly this invention relates to an male terminal for electrical connection which can be fitted to female terminals of various sizes.

2. Description of the Prior Art

Examples of conventional male terminals for electrical connection are illustrated in FIGS. 1 and 2.

The conventional male terminal 1 as shown in FIG. 1 is a flat terminal which comprises a front portion constituting an electrical connecting section made of a tab strip 1*a* (hereinafter referred to as "tab") and a rear portion constituting a wire connecting section 1*b* to which an electrical wire (not shown) is connected. Further, the other conventional male terminal 2 as shown in FIG. 2 is a male terminal of bus bar type having three tabs 2*a*, 2*b* and 2*c* as an electrical contact. The male terminal 2 is formed by bending end portions of a metal sheet punched to a predetermined shape.

Recently, junction blocks are usually used for electrical connection in automobiles and household electric appliances and so forth. In the junction blocks, ready-made parts are used as relays and connectors to which male terminals are connected. Therefore, female terminals attached to the relays and connectors to which the male terminals are fitted are in great variety of sizes and shapes.

FIGS. 3 and 4 show examples of female terminals to which the male terminals are fitted. Specifically, the female terminal 3 as shown in FIG. 3 comprises a tab receptacle 3*e* and wire connecting section 3*h*. The tab receptacle 3*e* has protruding contact surfaces 3*g* which are formed by bending elongated portions of the opposite sides of a base plate 3*f* semicircularly, respectively, so as to leave a space having a width of "l" between the each protruding contact surface 3*g* and the base plate 3*f*. The width of "l" is substantially equivalent to the thickness of the tab of the male terminal thereby the tab can be positively fitted to the female terminal.

Specifically, shapes and sizes of the tabs of the male terminals, of course, have to correspond to the shapes and sizes of the tab receptacles of the female terminals.

The female terminal 4 as shown in FIG. 4 has the same construction as that of FIG. 3 except for the shape of the tab receptacle 4*e*, that is, the elongated portions of the opposite sides of a base plate 4*f* are bent like a substantially box shape.

Recently, however, since female terminals attached to electrical parts in a junction block are, as stated above, various in size and shape, it is required to adjust size and thickness of a tab of a male terminal which is connected to the female terminal so as to fit to the size and shape of the female terminal.

In this connection, as methods for adjusting the thickness of a tab of a male terminal, which is formed from a metal sheet having a thickness different from a width of a space of a tab receptacle of a female terminal, so as to fit various widths of tab receptacles, the following two prior art receptacles have been known. One is the method disclosed in the Publication of examined Japanese Utility Model Application No. 60-37819, which is shown in FIG. 5, and the other is the method of obtaining a tab of a male terminal having a desired thickness by press working of metal sheet having a thickness which is greater than the desired thickness.

In the former method, a thickness of a metal sheet forming a bus bar is set to the thickness of a tab that has the smallest thickness among tabs of the bus bar. When a tab 5 with a desired thickness which is larger than the thickness of the metal sheet is required, a protruding portion 5*j* is formed on the tab 5 by pressing the metal sheet 5*i* outwardly, as shown in FIG. 5.

However, in such method, a difference in level between the pressed surface 5*k* of the protruding portion 5*j* and the surface 5*l* of the metal sheet 5*i* is limited to 25% of the increased thickness of the tab. When the difference level exceeds about 25%, there are disadvantages that it is liable to cause a crack in the metal sheet due to plastic deformation caused around the portion of the difference in level. In addition, it is also liable to cause a deterioration in electrical conductivity and lack of contactive reliability to the female terminal due to deterioration in the hardness of the metal plate. Further, it is impossible for the method to form a tab having relatively thin thickness for the metal sheet.

On the other hand, in the latter method, there exists such a problem that it is necessary to use a press machine with great capacity, therefore it is difficult to produce a male terminal having a wide tab area in the light of manufacturing and cost.

SUMMARY OF THE INVENTION

With these problems in mind, therefore, it is the primary object of the present invention to provide a male terminal for electrical connection which can be fitted to various female terminals having various sizes and shapes for the tab receptacle.

It is another object of the present invention to provide a male terminal for electrical connection which has a stability and reliability of electrical connection.

It is an other object of the present invention to provide a male terminal for electrical connection which also serves as a guide in the insertion of the male terminal to a female terminal.

In order to attain the objects, a male terminal for electrical connection fittable to a female terminal of this invention comprises; a tab as an electrical connection section, which is fitted to a tab receptacle of the female terminal when the male terminal is fitted to the female terminal sheet, and at least one recess formed on the one side of the tab so as to be contactable with protruding contact member provided on the tab receptacle of the female terminal.

In the male terminal according to the present invention, it is possible to fit the tab to the tab receptacles of the female terminal having various sizes and shape, since thickness of the tab can be varied with ease by adjusting a depth of the recess.

These and other objects and advantages of the present invention, as well as the details of an illustrative embodiment, will be more fully understood from the following specification and drawings, in which:

BRIEF DESCRIPTION OF THE DRAWINGS

FIG. 10 (B) is a sectional view taken along line X—X in FIG. 10 (A).

DETAILED DESCRIPTION OF THE PREFERRED EMBODIMENT

Figure 3:
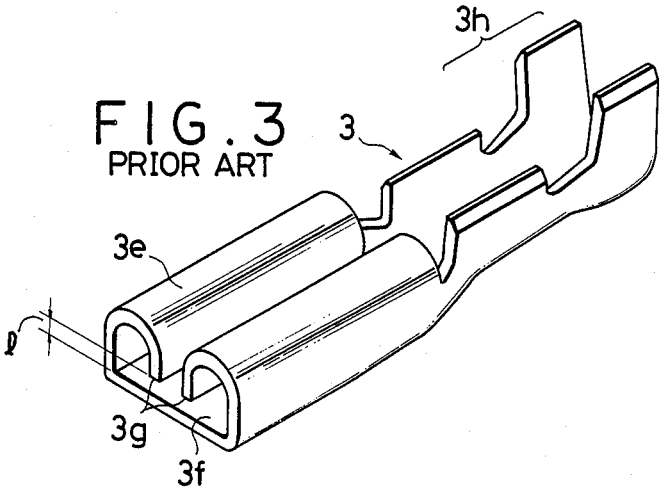
FIG. 3 PRIOR ART
FIG. 3 is a perspective view showing the conventional female terminal to which the male terminal is fitted.
Figure 6:
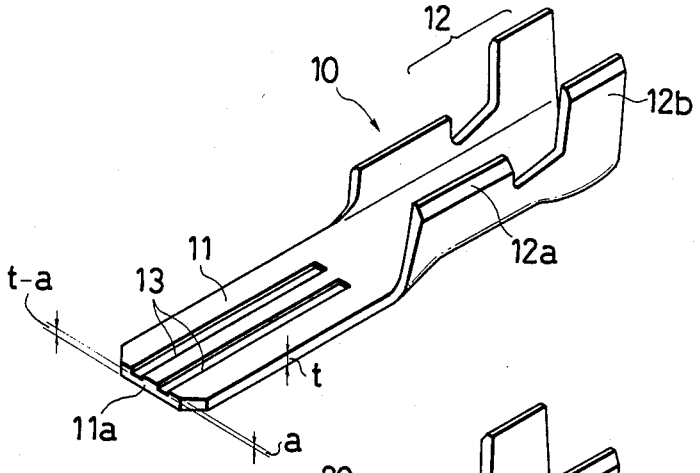
FIG. 6 is a perspective view of one embodiment of the male terminal for electrical connection according to the present invention.

Referring to FIG. 6, the male terminal 10 of the present invention comprises an electrical contacting section 11 (hereinafter referred to as "tab") and a wire connecting section 12 which are formed of a metal sheet. On one side of the tab 11, there are provided two parallel recesses 13 which are engaged with protruding contact surfaces 3*g* (see FIG. 3) provided on a tab receptacle of a female terminal when the male terminal is fitted to the female terminal. The recesses 13 are formed by forging processing and extend from a tip 11*a* of the tab 11 toward the wire connection section 12. The wire connecting section 12, which is connected to an electrical wire 12, (not shown) comprises a conductor caulking portion 12*a* and insulator caulking portion 12*b*.

Figure 4:
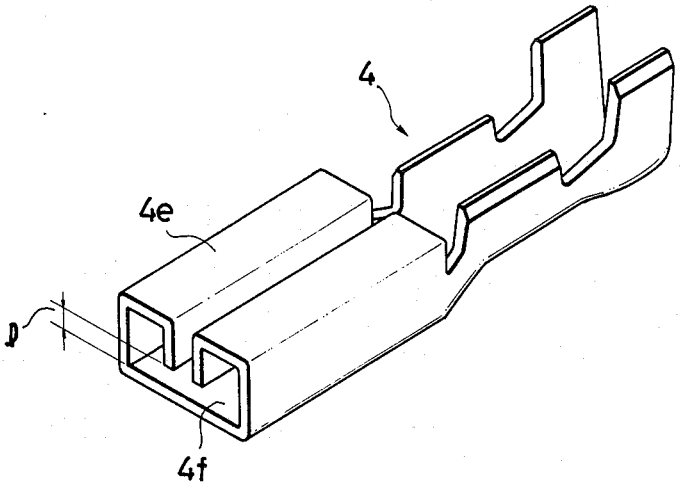
FIG. 4 PRIOR ART
FIG. 4 is a perspective view showing another conventional female terminal.
Figure 5:
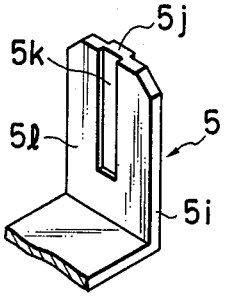
FIG. 5 PRIOR ART
FIG. 5 is a partial perspective view of the conventional tab which increases the thickness thereof by the prior-art method.

The male terminal having such construction described above is formed of a punched metal sheet having a thickness "t" larger than the width of the space of the tab receptacle of the female terminal (which is indicated by "l" in FIGS. 3, 4 and 9) to which the tab is fitted.

The recesses 13 provided on the upper side of the tab 11 are formed by forging processing which is performed by causing plastic deformation of a metallic material by hitting with a hammer. A distance subtracting the depth "a" of the recess 13 from the thickness of the tab 11 "t" (which corresponds to the thickness of the metal sheet), that is, the distance "t"−"a" substantially corresponds to the width of the space of the tab receptacle of the female terminal "l", thereby being able to obtain sufficient contacting pressure between the recesses 13 and the protruding contact surfaces.

Figure 7:
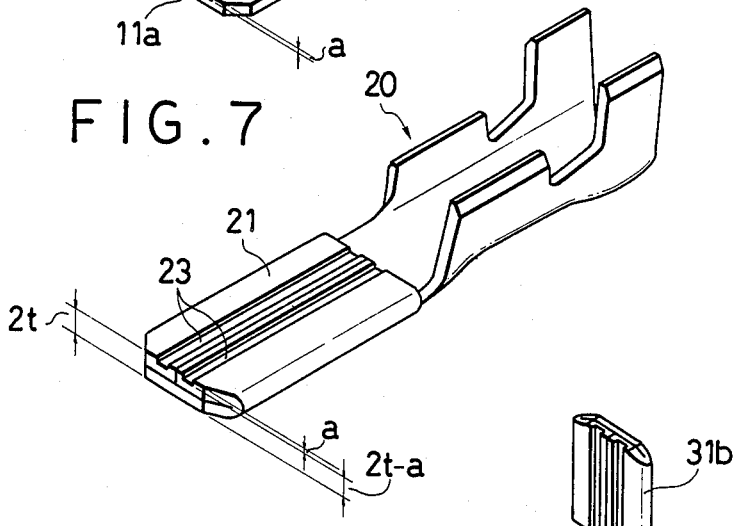
FIG. 7 is a perspective view of another embodiment of the male terminal for electrical connection according to the present invention.

FIG. 7 shows another embodiment of the present invention, which is used when a width of a space of a tab receptacle of a female terminal is larger than a thickness of a metal sheet forming a male terminal 20. Said male terminal 20 has the same construction as the male terminal 10 shown in FIG. 6 except for a construction of a tab 21, that is to say, the tab 21 has twice as large as the thickness "t" of the metal sheet. Said tab 21 is formed by folding back the extending portions on both sides of the metal sheet inwardly so as to double the thickness "t". There are provided two parallel recesses 23 on the tab 21 extending in a longitudinal direction.

Figure 9:
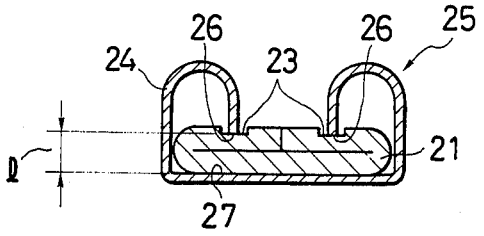
FIG. 9 is a sectional view showing the condition in which the male terminal of FIG. 7 is fitted to the female terminal.

In this case, a distance obtained by subtracting the depth "a" of the recess 23 from the thickness of the tab 21 "2t" ("2t"−"a") to be substantially corresponding to the width of the space of the tab receptacle of the female terminal (the width is indicated by "l" in FIG. 9). In other words, the thickness of the tab 21 at the portion in the recess 23 is substantially equivalent to the width of the space of the tab receptacle to which the male terminal is fitted. Therefore, it is also possible to obtain a sufficient contacting pressure between the protruding contact surfaces of the tab receptacle and the recesses 23.

Figure 1:
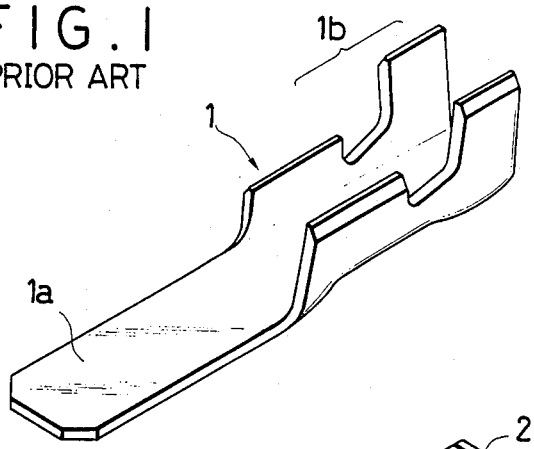
FIG. 1 PRIOR ART
FIG. 1 is a perspective view showing a conventional male terminal for electrical connection.
Figure 2:
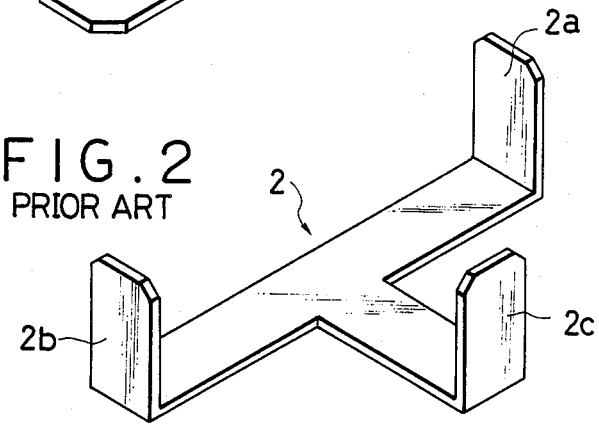
FIG. 2 PRIOR ART
FIG. 2 is a perspective view showing another conventional male terminal of a bus bar type.
Figure 8:
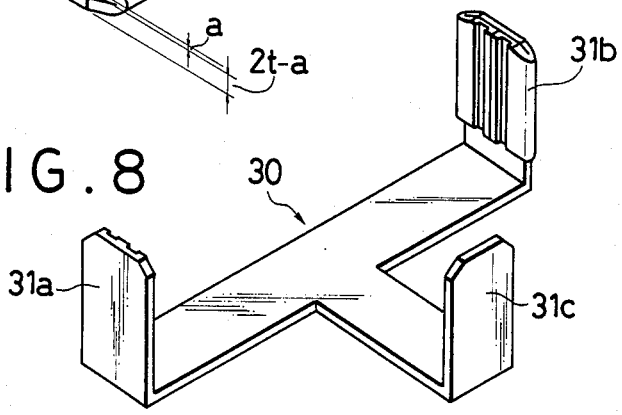
FIG. 8 is a perspective view of still another embodiment of the male terminal for electrical connection according to the present invention.

FIG. 8 is still another embodiment of the male terminal according to the present invention, which shows a bus bar 30 having three tabs 31*a*, 31*b* and 31*c*. The tab 31*a* is constructed in the same manner as the embodiment in FIG. 6, the tab 31*b* is constructed in the same manner as the embodiment in FIG. 7 and the tab 31*c* is the conventional male tab shown in FIG. 1 or 2. Therefore, the bus bar 30 can be used to a junction block which has various female terminals in various sizes and shapes.

FIG. 9 is a sectional view which shows the condition in which the tab 21 of the male terminal 20 in FIG. 7 is fitted to the tab receptacle 24 of the female terminal 25. By the recesses 23 formed on the upper surface of the tab 21, the tab 21 is fitted into the space between the protruding contact surfaces 26 and the base plate 27. In other words, the distance "l" between the protruding contact surface 26 and the upper surface of the base plate 27 is substantially equivalent to the thickness of the tab 21 at the portion in the recess 23.

Figure 10A:
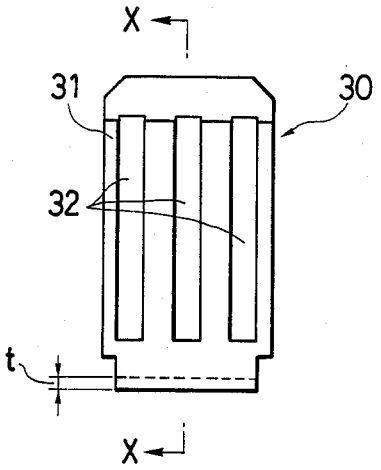
FIG. 10 (A) is an enlarged plan view of still another embodiment of the male terminal for electrical connection according to the present invention.
Figure 10B:
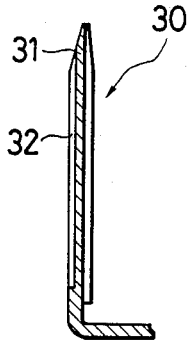

FIG. 10 (A) shows an embodiment of the male terminal 30 in a bus bar according to the present invention, and FIG. 10 (B) is a sectional view taken along line X—X in the FIG. 10 (A). In the male terminal, a tab 31 of the male terminal 30 has a double thickness of a metal sheet "t", which is formed by folding back the extending portions provided on the opposite sides of end portion of the metal sheet so as to double the thickness. Three parallel recesses 32 are formed on the underside of the tab 31 from a tip of the tab 31 toward the direction of the insertion of the tab 31.

Figure 11:
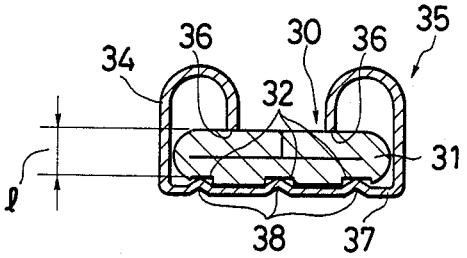
FIG. 11 is a sectional view showing the condition that the male terminal of FIG. 10 is fitted to a female terminal.

The tab 31 is used for connection to a tab receptacle 34 of a female terminal 35 which has three protruding contact portions 38 on a base plate 37 along the longitudinal direction, as shown in FIG. 11 which shows a condition that the male terminal 30 is fitted to the female terminal 35. As shown in FIG. 11, each recess 32 is engagement with each protruding contact portion 38, respectively. In this case, the thickness of the tab 31 at the position in the recess 32 is substantially equivalent to the distance between a protruding contact surface 36 of the tab receptacle 34 and the tip of the protruding contact portion 38, which is indicated by "l" in FIG. 11. Thereby, a sufficient contacting pressure can be obtained when the male terminal 30 is fitted to the female terminal 35.

Figure 12:
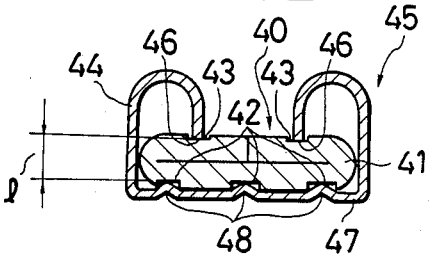
FIG. 12 is a sectional view of still another embodiment of a male terminal for electrical connection according to the present invention, which shows the condition that the male terminal is fitted to a female terminal.

FIG. 12 is a sectional view of still another embodiment of a male terminal 40 for electrical connection according to the present invention, which shows the condition that the male terminal 40 is fitted to a tab receptacle 44 of a female terminal 45. The male terminal 40 has a construction combining the features of the embodiments of FIGS. 7 and 10. Specifically, a tab 41 of the male terminal 40 has a plurality of recesses 42, 43 on the both sides of the tab 41, respectively. That is to say, two parallel recesses 43 are formed on the topside of the tab 41 so as to extend in a longitudinal direction, while on the underside thereof three parallel recesses 42 are formed in the same direction. These recesses 42, 43 are also formed by forging processing. The topside recesses 43 are in engagement with protruding contact surfaces 46 of a tab receptacle 44, respectively, when the male terminal 40 is fitted to the female terminal 45. On the other hand, the underside recesses 42 are in engagement with protruding contact portions 48 on a base plate 47 of the tab receptacle 44, respectively, when the male terminal 40 is fitted to the female terminal 45.

In this embodiment, the distance between the tip of the protruding contact surface 46 and the tip of the protruding contact portion 48, which is indicated by "l" in FIG. 12, is substantially equivalent to the length obtained by subtracting the depths of the recess 42 and recess 43 from the thickness of the tab 41. Thereby, conductivity and contacting reliability are further improved.

In use, if a width of a space of a tab receptacle of a female terminal is smaller than a thickness of a metal sheet forming a tab of a male terminal, recesses each having a depth which is substantially equivalent to a length subtracting the width of the space of the tab receptacle from the thickness of the tab are formed on the tab by forging processing in order to fit the tab to the tab receptacle. On the other hand, if a width of a space of a tab receptacle is greater than the thickness of the metal sheet forming the tab, at first, a tab having double thickness of the metal sheet is made by folding back elongated portions provided on the opposite sides of the metal sheet inwardly so as to be double, and thereafter, recesses each having a depth which is substantially equivalent to a length subtracting the width of the space of the tab receptacle from the thickness of the tab are formed on the tab by forging processing in order to fit the tab to the tab receptacle.

From the foregoing, the male terminal for electric connection according to the present invention has the following effects. That is to say, it is possible to form a male terminal having necessary tab thickness from a metal sheet having a thickness which is different from the width of a space of a tab receptacle of the female terminal to which the male terminal is fitted. In other words, it is possible to provide the male terminal which can be adapted to various female terminals having various tab receptacle sizes and shapes, by adjusting the depth of the recesses 23 adequately. Further, adjustment of the thickness of the tab is extremely easy, since the adjustment can be performed only by formings on the tab by forging processing employing hammering. Furthermore, since a recess is formed by the forging processing, a metal structure around the recess becomes harder, thereby strength of the male terminal is increased, and conductivity and contacting reliability are also improved. Furthermore, the recess is used as a guide for the male terminal when the tab is fitted to the female terminal and, contacting stability between the terminals can also be thereby improved.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A male terminal for electrical connection adapted to fit a female terminal for electrical connection, said female terminal having a tab receptacle which includes a base plate portion and two protruding contact surfaces formed by bending both sides of the base plate portion inwardly and semicircularly, comprising:

a wire connection section; and an electrical contacting section connected to said wire connection section, said electrical contacting section having at least a longitudinally extending tab to be fitted to the tab receptacle of the female terminal, the tab having a thickness which is larger than the width of the tab receptacle which is measured between each of the protruding contacting surfaces and the base plate portion, and said tab having an upper side and two parallel recesses being formed thereon, and said recesses extending from a tip of the tab toward the direction of the insertion of the tab into the female terminal and being adapted to engage with said protruding contact surfaces of the tab receptacle, respectively, when fitted, whereby said tab is tightly fitted to the tab receptacle by adjusting the depth of each recess so as to fit the thickness of the tab at the recess to the width of the tab receptacle.

2. A male terminal for electrical connection as set forth in claim 1, wherein said tab is formed from a sheet of metal which has a thickness larger than the width of the tab receptacle of the female terminal.

3. A male terminal for electrical connection as set forth in claim 1, wherein said male terminal is formed from a sheet of metal having a predetermined thickness and said tab is formed from a double thickness of said metal sheet.

4. A male terminal for electrical connection as set forth in claim 1, wherein said male terminal has a single tab.

5. A male terminal for electrical connection as set forth in claim 1, wherein the recesses are formed by forging processing.

6. A male terminal for electrical connection as set forth in claim 5, wherein said tab having a lower side and a plurality of recesses are arranged in parallel thereon, and the recesses are adapted to engage with protruding contacting portions formed on said base plate of the tab receptacle of the female terminal, respectively.

7. A male terminal for electrical connection as set forth in claim 1, wherein said male terminal is a bus bar type which has a plurality of tabs.

8. A male terminal for electrical connection as set forth in claim 7, wherein said tabs have different thicknesses, respectively.

* * * * *